United States Patent [19]

Hyun

[11] 4,014,477

[45] Mar. 29, 1977

[54] KITE REEL

[76] Inventor: Terry C. Hyun, 3421 Rivera St., San Francisco, Calif. 94116

[22] Filed: Oct. 9, 1975

[21] Appl. No.: 620,951

[52] U.S. Cl. ..... 242/96

[51] Int. Cl.[2] ..... B65H 75/48

[58] Field of Search ..... 242/96, 99, 100, 84.8; 244/155

[56] References Cited

UNITED STATES PATENTS

| | | | |
|---|---|---|---|
| 438,718 | 10/1890 | Truman | 242/96 |
| 850,236 | 4/1907 | Maguire | 242/96 |
| 1,414,237 | 4/1922 | Wanner | 242/96 |
| 2,896,898 | 7/1959 | Wetzel | 242/99 |
| D165,269 | 11/1951 | Cordell | 244/155 X |

*Primary Examiner*—Edward J. McCarthy
*Attorney, Agent, or Firm*—Drummond, Nelson & Ptak

[57] ABSTRACT

A kite reel is disclosed. The reel has a spool formed from two or more axial rods joined by a cross member. The outer ends of the rods carry a rotating sleeve which serves as a crank. An axially extending elongated handle which can be engaged along the flyer's forearm projects from the other end of the spool. The balance point of the device is approximately where the handle and the spool are connected. In another embodiment the spool may be formed from a cylindrical drum.

6 Claims, 6 Drawing Figures

KITE REEL

The present invention relates to a winding reel and more particularly relates to a reel for controlling the winding and unwinding of line while flying a kite.

Kite flying has existed as a form of sport and recreation for over 3,000 years probably originating in Asia. Many forms of kites exist today from the simple two stick kite constructed of cross members covered by strong paper or cloth and connected by bridle to a string to exotic designs utilizing para-foil wings. Kites are normally tethered by a line and the individual flying the kite controls the movement of the kite by manipulating the end of the line.

Light kites may exert only a few pounds pull on the line while some of the para-foil designs can exert hundreds of pounds of pull. Accordingly, kite flyers often use some type of control handle or device. For ease and convenience the user often wraps the tether line about an elongated rod or other object. The user can then wind or pay-out line from the rod as desired and control the kite. This simple expedient is suitable for light kites.

It is also known to connect a kite to the end of the line to conventional open-faced fishing reel attached to a fishing rod. This arrangement gives the kite flyer a greater degree of control, particularly with larger kites where substantial tension is imposed on the line.

It is also known to construct winding reels especially for use for flying kites. The most simple of these reels are the "clothesline" type in which a short handle is attached to a reel. The line is wound about the reel. The disadvantage of this type of reel is that they are cumbersome and do not provide the user with any great degree of control or leverage.

A more recent improvement in kite reels is shown in U.S. Pat. No. 3,357,654 in which the reel is attached to a winding crank and the reel and crank assembly are, in turn, secured to a Y-shaped handle.

The present invention provides a substantial improvement over kite winding reels of the prior art. The kite reel of the present invention can be easily and inexpensively constructed from a wide range of available materials. The reel of the present invention is simple and convenient to operate and gives the kite flyer a high degree of control allowing the kite flyer to easily manipulate the kite and quickly pay-out or take in line. The reel of the present invention is simple and as contemplated would be made in a range of sizes for use by kite flyers ranging from children to experts. The reel of the present invention would be convenient for recreational kite flying and would be particularly useful in competition flying involving endurance, height or combat situations.

Briefly, the kite reel of the present invention includes a spool portion upon which the kite string is wound or unwound. Projecting from one end of the spool are one or more crank handles to allow rapid rotation of the spool. The crank handles are rotatable. An elongated handle concentrically located with respect to the spool extends from the opposite side of the spool. The handle is preferably of greater length than the spool and the center gravity of the device is located along the handle at a location approximately where the handle joins the spool so the user can easily balance the reel and stabilize the reel by positioning the handle along the user's forearm. In the preferred embodiment, the spool is formed from two or more elongated rods joined by cross frame members to which the handle is also connected.

The above and other objects of the present invention will become more apparent from the following description, claims and drawings in which:

Figure 1:
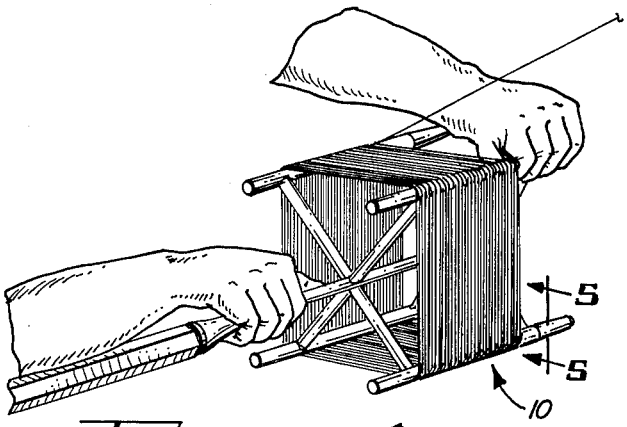
FIG. 1 illustrates the kite reel of the present invention in a position of use.
Figure 2:
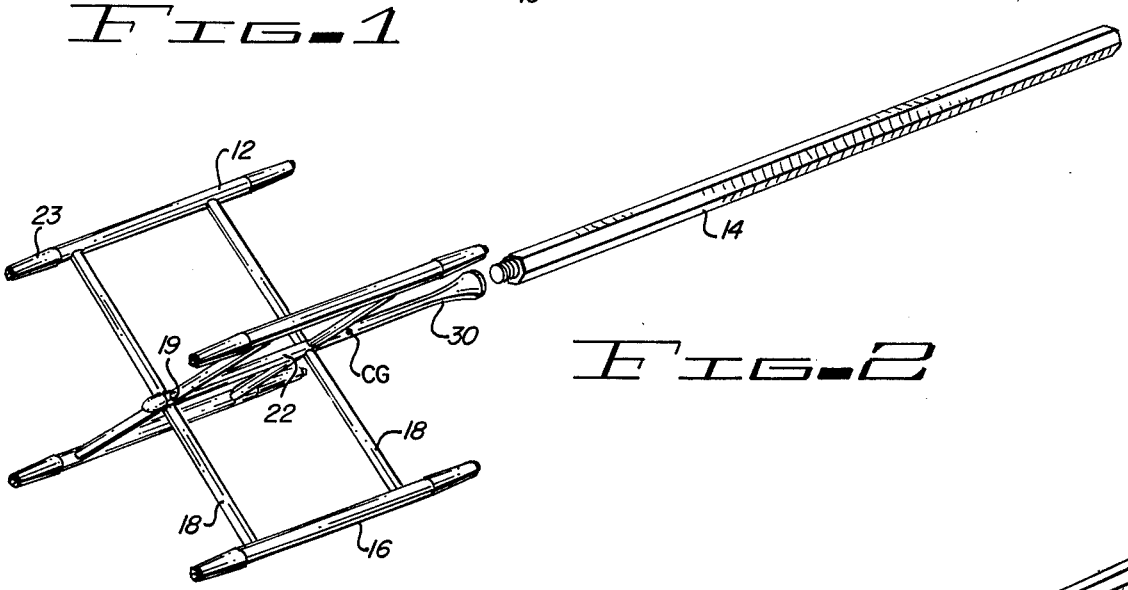
FIG. 2 is a perspective view of the preferred embodiment of the kite reel of the present invention.

Referring now to the drawings, FIGS. 1 and 2 illustrate a preferred embodiment of the present invention. The kite reel of the present invention is generally designated by the numeral 10 and includes a spool 12 and an axially projecting, elongated handle 14. The spool 12 is constructed of parallel leg members or rods 16 positioned to form the spool about which the kite string is wound. Preferably the rods 16 are arranged in a regular pattern being equidistant from one another. As shown, the rods 16 are positioned in a rectangular arrangement when viewed in cross section. A pair of cross frame members 18 serve to secure rods 16 in place. The spindle portion 22 of handle 14 extends through holes or bores 19 provided at the center of cross members 18 and concentrically aligned with respect to rods 16. The outer end of the spool is open, that is, unobstructed so that there is no flange or obstruction to interfere with the line.

Figure 5:
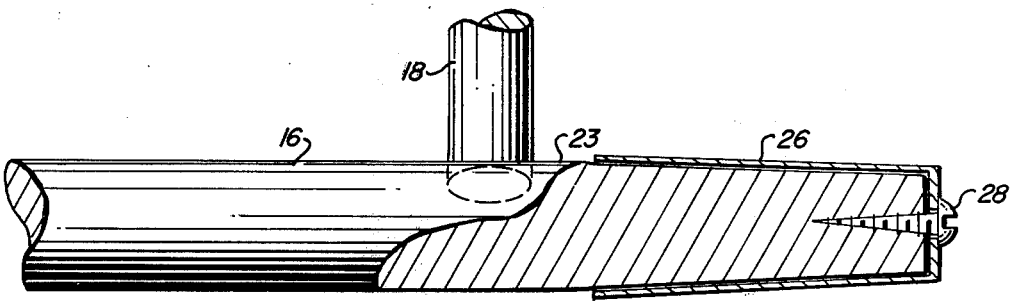
FIG. 5 is a sectional view taken along lines 5—5 of FIG. 1 and shows the crank handles in detail.

In order to facilitate rapid winding of the reel, the outer ends of rods 16 project beyond the outer cross member to form crank handles 23. As seen in FIG. 5, each of the crank handles are provided with a sleeve 26 mounted for rotation relative to the handle 23 by means of concentric rivet or screw 28. As will be explained hereafter, the user can grasp one of the crank sleeves 26 and quickly rotate thr reel frame to take up string when desired.

Handle 14 is elongated and extends from the inner side of the reel frame a distance approximately at least equal to the overall length of the spool 12. Handle 14 can be of any convenient shape but is preferably some regular geometric shape such as octagonal as shown. This provides a positive, frictional grip for the user. A neck portion 30 of handle 14 is tapered and is smooth. The relative weight of the handle 14 and spool assembly are selected so that the center of gravity of the entire reel lies somewhere in the neck area 30 as indicated by the letters CG. Therefore, as will be explained hereafter, the user can easily control the device with one hand by grasping the handle and the neck portion and can easily rotate the handle 14 with the other hand for control.

Figure 6:
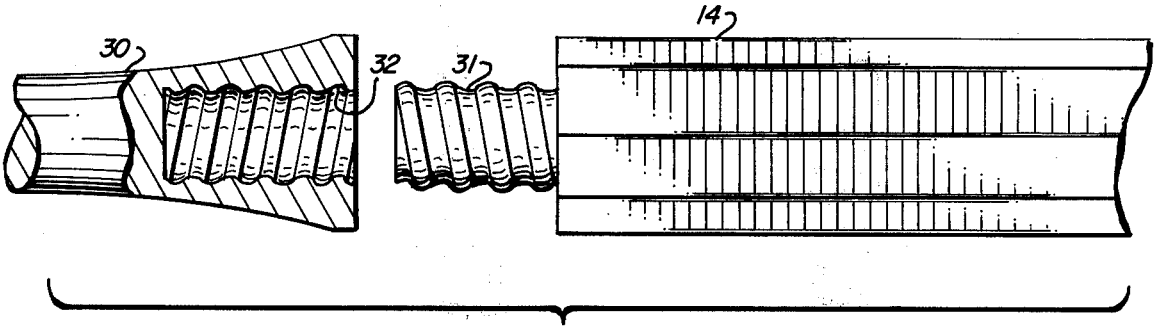
FIG. 6 illustrates detail of construction of the handle.

For convenience of shipping and storage, handle 14 may be removable. As best seen in FIG. 6, the inner end of handle 14 is threaded at 31 and the threads are engageable in mating threads 32 provided in the neck 30. Thus, the reel can be assembled or disassembled by the user.

The device will be more completely understood from the following description of use. The kite spool 12 is wound with a suitable length of cord or line. The line can be any type such as braided, fiber or synthetic such as nylon. This is done by tying the end of the line to one of the rods 16 at a location intermediate the cross members 18. The selected length of line is wrapped about the rods 16 which forms the spool. The free end is then attached to the kite usually at a bridle. The kite is launched in the conventional manner. The user will grasp the reel with one hand near its outer end of handle 14 and grasp the handle at the neck portion 30 with the other hand. In this mode, the kite reel is balanced and kite string can be payed-out by simply allowing the handle to loosely turn in the user's hand. Applying pressure with the hand will brake the rotation and slow or stop paying line out. The long handle 14 can be engaged along the underside of the user's arm as seen in FIG. 1. In this way the reel can be easily stabilized and substantial leverage can be obtained against the force of kites which exert large tension forces. The open face spool is particularly advantageous when line is payed out rapidly as the reel can be held vertically and line unwound from the outer, upper end. There are no flanges or other obstructions to interfere with the unwinding of the line.

If it is desired to take up string, the handle 14 can be rotated by the user causing the spool 12 to quickly rotate. Since the spool is of substantially larger diameter than handle 14, each turn of the handle will take up a substantial length of line permitting very rapid take up. Alternately, the user can grasp the handle 14 at neck portion 30 and with the other hand grasp one of the crank handle sleeves 26 and crank the reel frame. Since the crank handles 26 are radially spaced from the axial center of handle 14, a substantial mechanical advantage exists. This mode of operation would be used if the kite is exerting substantial tension on the reel. The design allows the user rapid rotation as the user can "throw" the reel in a first winding motion. Note that the sleeve or any of the rods 16 can be used for this purpose so that the flyer can quickly shift to reeling operation without any difficulty.

Figure 3:
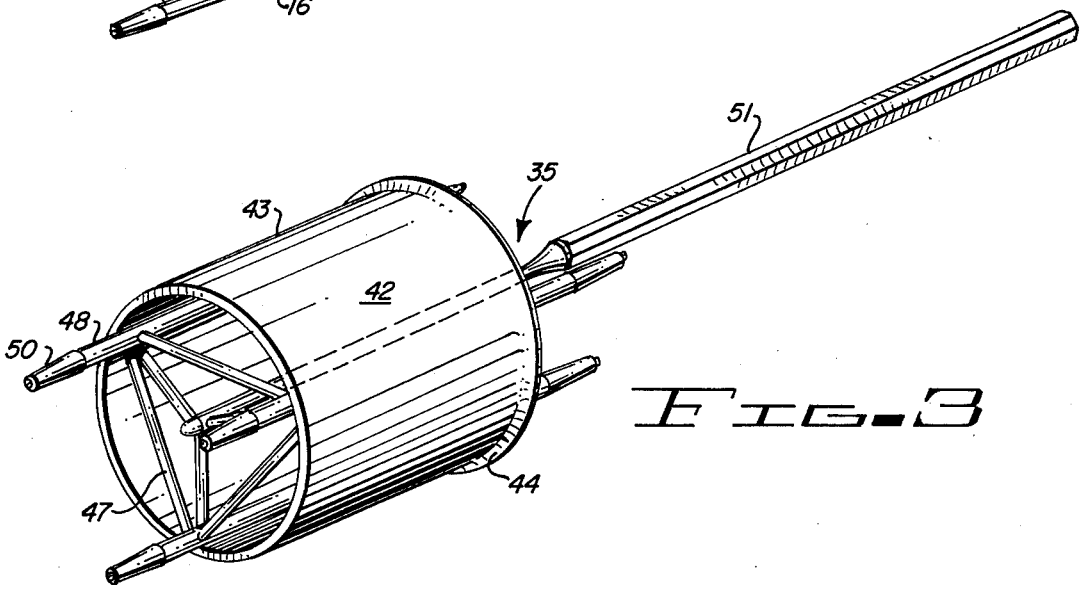
FIG. 3 is a perspective view of an alternate embodiment of the kite reel of the present invention.

Another embodiment of the present invention is shown in FIG. 3 and is generally designated by the numeral 35. In this embodiment the spool is formed from a cylindrical drum 42 which defines a spool surface 43. The spool is provided with an inner flared end 44. Internal support member 47 within the drum secures handle 51 concentrically with respect to the drum. The handle 51 projects from the drum and has an axial length at least or greater to that of the drum. Again, the center of gravity of the device is located in the area approximately where the handle joins the drum. One or more crank handles 48 are secured to the drum at the edge opposite the handle. Three have been shown arranged 120° apart on the circumference of the drum. Each is provided with a sleeve 50 which is rotatable relative to the handles 48. Thus, handle 51 may be conveniently held in the one hand of the user and one of the crank sleeves 50 employed to rotate the spool to provide an effective crank which facilitates operation of the reel. Handle 51 may also be removable from the spool for convenience. As has been described with reference to previous embodiments, the kite reel of this embodiment gives the user substantial leverage and a high degree of control while flying the kite.

Figure 4:
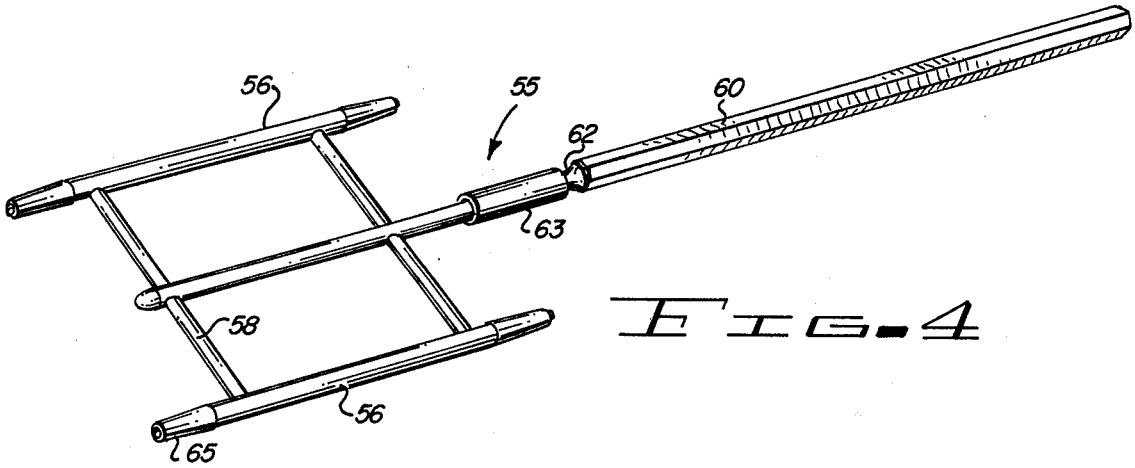
FIG. 4 is a perspective view of still another embodiment of the kite reel of the present invention.

FIG. 4 shows another alternate construction of the kite reel of the present invention designated by the numeral 55. The kite reel shown in this figure is substantially the same as that shown in 1 and 2 except that the spool is formed from two diametrically opposed rods 56 mounted at opposite ends of a pair of single cross members 58. The handle 60 again projects from one side of the spool having a neck portion 62 adjacent the spool. Again, the center of balance is located along the handle adjacent to spool in the neck area 62. The left end of the rods 56, as viewed in this drawing, are each again provided with sleeve 65. In addition, a sleeve 63 is rotatable about the neck portion of handle 60. Sleeve 63 facilitates rapid turning of the reel and can be grasped in one hand while the reel is rotated with the other at handle 60. In other respects of construction and operation, the reel shown in FIG. 3 is the same as that described with reference to FIGS. 1 and 2.

The kite reel of the present invention provides convenience for storage of line and substantial control when flying. Line may be payed out at a controlled rate by the user allowing the handle to turn freely in the user's hand. Similarly take up of string can be accomplished by rotating either the handle or when necessary to take up against tension, using the crank handles. The reel can be held vertically or horizontally and the long handle provides the flyer with substantial leverage so the flyer does not become tired in long periods of flying. Oscillations and drift can be controlled and undesired maneuvers such as power loops can be more easily avoided.

The device of the present invention can be easily and inexpensively constructed. The device can be readily molded from plastic and when assembled provide a strong, durable and simply operatable device. The device can also be manufactured from wood, preferably a hardwood such as oak, and provide durability and long, useful life. For convenience of storing and shipping the device can be disassembled. In some cases it may be desirable to make the unit collapsible.

It is also possible to equip the reel of the present invention with a string guide. A string guide can simply comprise a wire loop or eyelet affixed to the reel frame or spool assembly so that the line is guided as it is taken up or payed out.

It is to be understood that it will be obvious to those skilled in the art to make various changes, alterations and modifications to the device herein chosen for purposes of illustration. It is to be understood that such changes, alterations and modifications are contemplated within the scope of the present invention.

I claim:

1. A kite reel for controlling the winding and unwinding of a line comprising:

a. a spool member having an inner and an outer end, said spool member adapted for reception of a length of line about the spool, the outer end of said spool permitting unobstructed winding and unwinding of line;

b. an elongate handle having a length substantially greater than the axial length of said spool member, said handle extending from the inner end of said spool at a generally central location, said handle defining a neck portion adjacent the inner end of said spool, said spool member and handle having a center of balance in the said neck area at which center of balance the user can balance the reel extending the handle substantially along the user's forearm to stabilize the reel; and c. at least one crank handle associated with said spool and extending from the outer end of said spool and radially offset from the axis of the handle, said crank being rotative independently of said spool whereby the winding and unwinding of line is manually facilitated.

2. The reel of claim 1 wherein said spool comprises at least two axially extending rod members joined by a cross frame member.

3. The reel of claim 1 wherein said spool comprises a cylindrical drum.

4. The reel of claim 1 wherein said crank handle is provided with sleeve means rotatable relative to said handle.

5. The reel of claim 1 wherein said handle is removable from said spool.

6. The reel of claim 1 wherein said handle is provided with a sleeve concentrically positioned about the handle in the neck area and rotatable relative to said handle.

* * * * *